US011588237B2

(12) United States Patent
Pu et al.

(10) Patent No.: US 11,588,237 B2
(45) Date of Patent: Feb. 21, 2023

(54) ANTENNA STRUCTURE

(71) Applicant: HTC Corporation, Taoyuan (TW)

(72) Inventors: Ta-Chun Pu, Taoyuan (TW); Chien-Ting Ho, Taoyuan (TW); Yen-Liang Kuo, Taoyuan (TW)

(73) Assignee: HTC Corporation, Taoyuan (TW)

( * ) Notice: Subject to any disclaimer, the term of this patent is extended or adjusted under 35 U.S.C. 154(b) by 727 days.

(21) Appl. No.: 16/219,918

(22) Filed: Dec. 13, 2018

(65) Prior Publication Data

US 2020/0194886 A1 Jun. 18, 2020

(51) Int. Cl.

| | |
|---|---|
| ***H01Q 3/24*** | (2006.01) |
| ***H01Q 9/04*** | (2006.01) |
| ***H01Q 21/06*** | (2006.01) |

(52) U.S. Cl.

CPC ..... *H01Q 3/24* (2013.01); *H01Q 9/0407* (2013.01); *H01Q 21/064* (2013.01)

(58) Field of Classification Search

CPC ..... H01Q 3/24; H01Q 9/0407; H01Q 21/064
See application file for complete search history.

(56) References Cited

U.S. PATENT DOCUMENTS

| | | | | |
|---|---|---|---|---|
| 2007/0040629 | A1 | 2/2007 | Yoneyama et al. | |
| 2007/0052587 | A1* | 3/2007 | Cheng | H01Q 9/0457 343/700 MS |
| 2010/0026601 | A1* | 2/2010 | Chang | H01L 23/66 343/834 |
| 2012/0256707 | A1 | 10/2012 | Leiba et al. | |
| 2014/0028515 | A1 | 1/2014 | Lu et al. | |
| 2014/0132473 | A1 | 5/2014 | Isom | |
| 2015/0070231 | A1* | 3/2015 | Park | H01Q 21/08 343/777 |
| 2018/0040955 | A1 | 2/2018 | Vouvakis et al. | |
| 2018/0062257 | A1 | 3/2018 | Kausar et al. | |
| 2018/0309198 | A1 | 10/2018 | Yu et al. | |

FOREIGN PATENT DOCUMENTS

| | | | |
|---|---|---|---|
| CN | 101114733 | A | 1/2008 |
| CN | 101496224 | B | 12/2012 |
| CN | 103606757 | A | 2/2014 |
| CN | 105449345 | A | 3/2016 |
| CN | 106252878 | A | 12/2016 |
| CN | 106463830 | A | 2/2017 |

(Continued)

OTHER PUBLICATIONS

Corresponding Taiwan office action dated Dec. 27, 2019.

(Continued)

*Primary Examiner* — Graham P Smith
(74) *Attorney, Agent, or Firm* — CKC & Partners Co., LLC

(57) ABSTRACT

An antenna structure is provided, which includes a substrate, a horizontal radiator and a vertical radiator. The horizontal radiator is on or in the substrate. The vertical radiator is in the substrate and includes a vertical conductor, planar metal structures and a switch. The planar metal structures are electrically connected through the vertical connector. The switch is in a gap of the planar metal structures and is coupled to at least one of the planar metal structures for switching a current distribution of the vertical radiator.

14 Claims, 9 Drawing Sheets

(56) References Cited

FOREIGN PATENT DOCUMENTS

CN 108808237 A 11/2018

OTHER PUBLICATIONS

Corresponding Taiwan office action dated Apr. 25, 2022.
Corresponding Chinese office action dated Dec. 14, 2021.
Corresponding Chinese office action dated Mar. 21, 2022.
Jian Wang, "Investigation on 60GHz InP On-chip Antenna", Dissertation submitted to Hangzhou Dianzi University for the Degree of Master, Apr. 2016.
Jun Hu et al., "A two-dimensional beam-switchable patch array antenna with polarization-diversity for 5G applications", 2018 IEEE MTT-S International Wireless Symposium (IWS), 2018.
Corresponding Chinese Notice of Allowance dated Jun. 22, 2022.
Corresponding Taiwan office action dated Sep. 2, 2020.

* cited by examiner

ANTENNA STRUCTURE

BACKGROUND

Technical field

The invention relates to an antenna structure, and more particularly to an antenna structure that is capable of switching its radiation pattern.

Description of Related Art

With the vigorous development of communication technologies, commercial mobile communication systems can achieve high-speed data transmission, and provide Internet service providers with a wide range of services, such as network services of multimedia video streaming, instant road reporting and navigation, and instant network communication that require huge data transmission quantity. For hardware, an antenna design affects the performance of the wireless signals transmitting and receiving. Further, the conventional antenna does not have radiation pattern switching functions, and therefore its performance tends to be limited due to its surrounding environment. Therefore, how to design a high-performance antenna is one of the goals in the related industries.

SUMMARY

The objective of the invention is to provide an antenna structure that has radiation pattern switching functions of switching its radiation pattern based on its surrounding environment, thus achieving high transmission and reception performances under various environments.

One aspect of the invention relates to an antenna structure which includes a substrate, a horizontal radiator and a vertical radiator. The horizontal radiator on or in the substrate. The vertical radiator is in the substrate and includes a vertical conductor, plural planar metal structures and a switch. The planar metal structures are electrically connected through the at least one vertical conductor. The switch is in a gap of the planar metal structures and is coupled to at least one of the planar metal structures for switching a current distribution of the vertical radiator.

Another aspect of the invention relates to an antenna structure which includes a substrate, a horizontal radiator, a vertical radiator and a metal branch. The horizontal radiator is on or in the substrate. The vertical radiator is in the substrate and includes a vertical conductor and plural planar metal structures. The planar metal structures are electrically connected through the vertical conductor. The metal branch is selectively coupled to the vertical radiator.

Another aspect of the invention relates to an antenna structure which includes a substrate, a horizontal radiator, a vertical radiator and a metal branch. The horizontal radiator is on or in the substrate. The vertical radiator is in the substrate and includes a vertical conductor and plural planar metal structures. The planar metal structures are electrically connected through the vertical connector. The switch is in a gap of the planar metal structures and is coupled to at least one of the planar metal structures for switching a current distribution of the vertical radiator. The metal branch is selectively coupled to the vertical radiator.

BRIEF DESCRIPTION OF THE DRAWINGS

Embodiments and advantages thereof can be more fully understood by reading the following description with reference made to the accompanying drawings as follows.

DETAILED DESCRIPTION

Figure 1A:
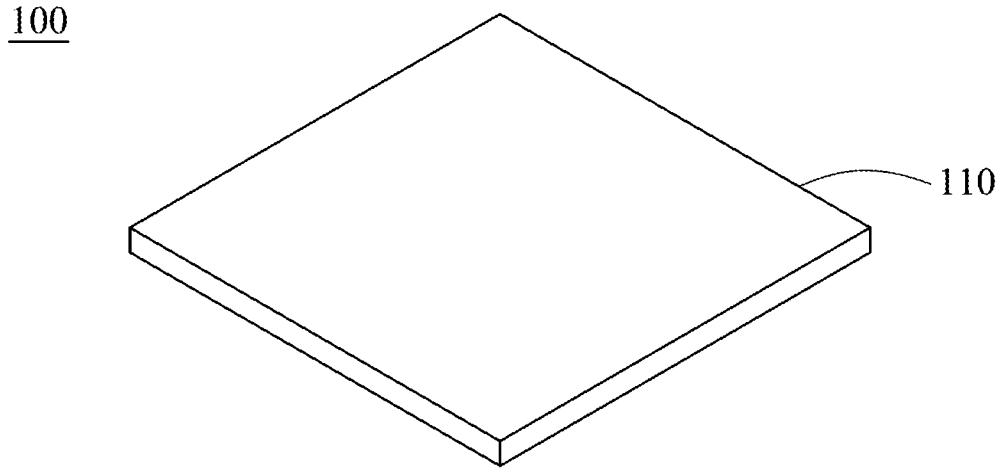
FIG. 1A and FIG. 1B are respectively a perspective view and a top-view of an antenna structure in accordance with some embodiments of the invention.

The spirit of the disclosure is clearly described hereinafter accompanying with the drawings and detailed descriptions. After realizing preferred embodiments of the disclosure, any persons having ordinary skill in the art may make various modifications and changes according to the techniques taught in the disclosure without departing from the spirit and scope of the disclosure.

Terms used herein are only used to describe the specific embodiments, which are not used to limit the claims appended herewith. Unless limited otherwise, the term "a," "an," "one" or "the" of the single form may also represent the plural form. Further, the spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The document may repeat reference numerals and/or letters in the various examples. This repetition is for the purpose of simplicity and clarity and does not in itself dictate a relationship between the various embodiments and/or configurations discussed.

Further, spatially relative terms, such as "over," "on," "under," "below," and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures.

Figure 1B:
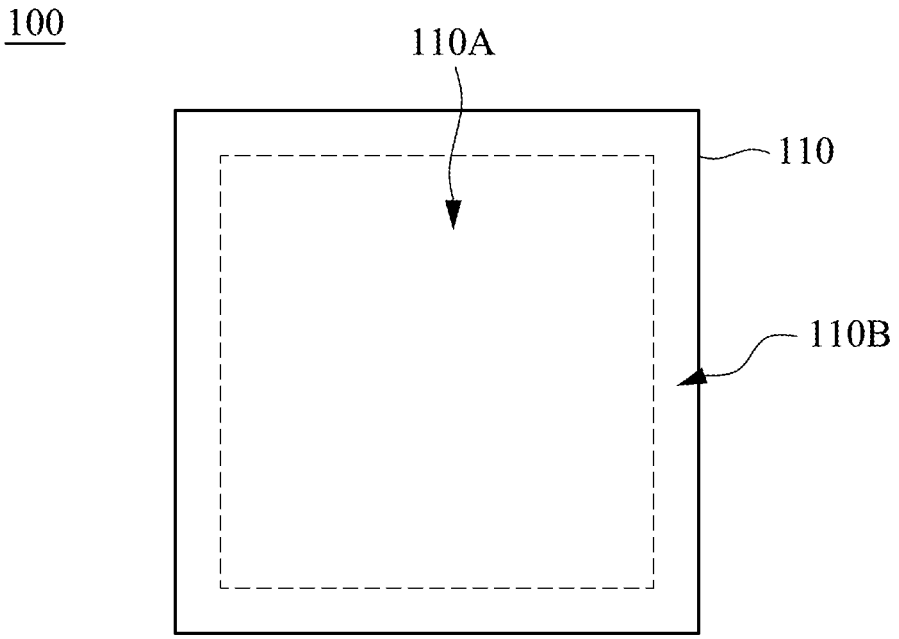

Referring to FIG. 1A and FIG. 1B, FIG. 1A and FIG. 1B are respectively a perspective view and a top-view of an antenna structure 100. The antenna structure 100 include at least a substrate 110 and components disposed on or in the substrate 110, such as radiation elements, conductive lines, switches and/or other components. The substrate 110 has a center area 110A and a peripheral area 110B. The center area 110A has components for transmitting electrical signals, while the peripheral area 110B has radiators.

Figure 2:
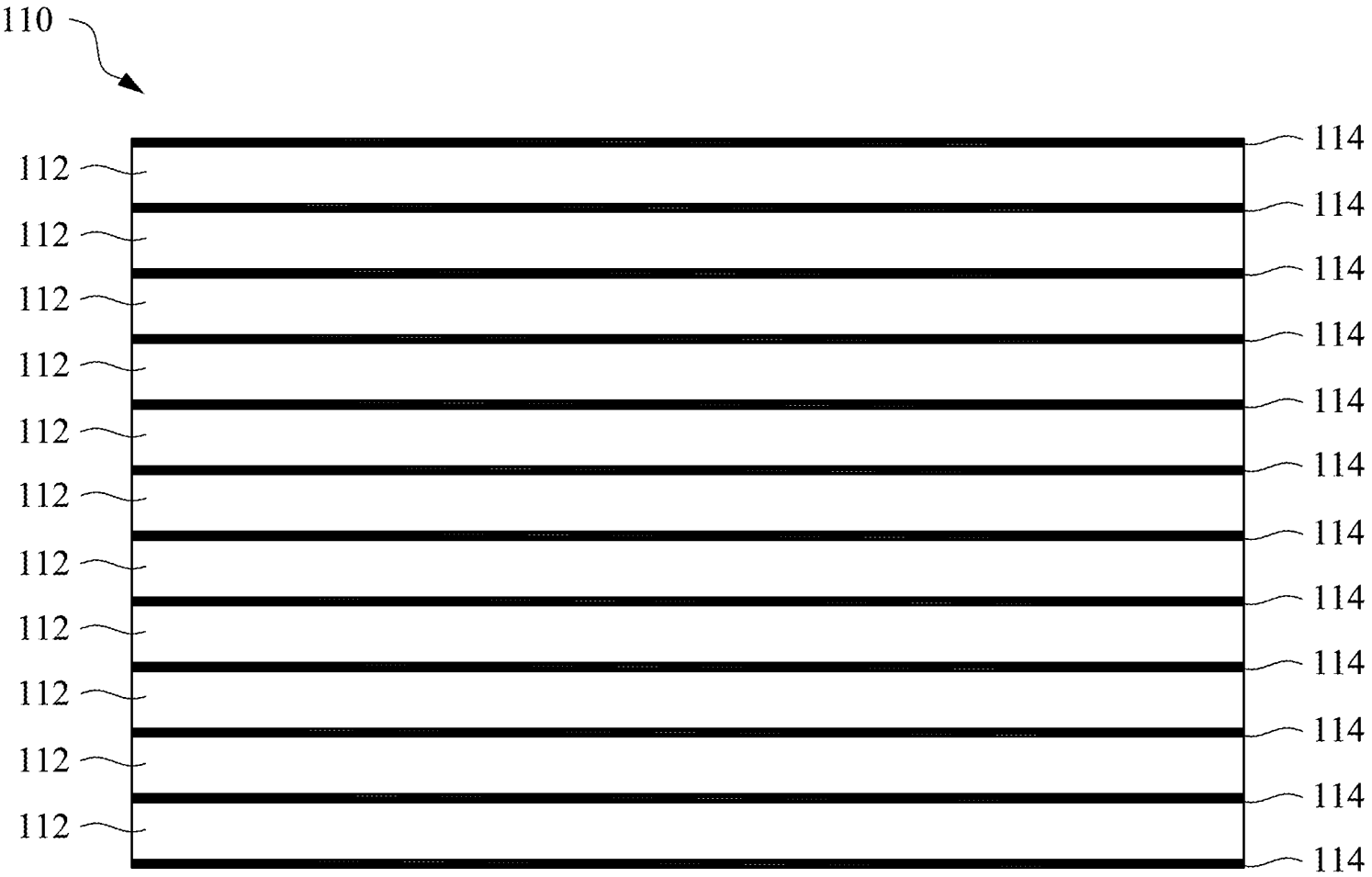
FIG. 2 is a cross sectional view of the antenna structure in FIG. 1A.

FIG. 2 is a cross sectional view of the antenna structure 100 in FIG. 1A. As shown in FIG. 2, the substrate 110 is a multi-layered board structure formed of alternately stacked dielectric layers 112 and metal layers 114. Each dielectric layer 112 may be formed from FR4 material, glass, ceramic, epoxy resin or silicon, and each metal layer 114 may be formed from copper, aluminum, nickel and/or another material. In addition, each metal layer 114 may include a radiator element, a conductive line, a switch or another component needed to form a radiation structure and an electrical signal transmission structure. The metal layers 114 may include different patterns based on the components formed in the metal layers 114. Moreover, the substrate 110 may be formed by various processes, such as low-temperature cofired ceramic (LTCC), integrated passive device (IPD), multi-layered film, multi-layered printed circuit board (PCB) or another multi-layered process based on the material type of the dielectric layers 112.

Figure 3:
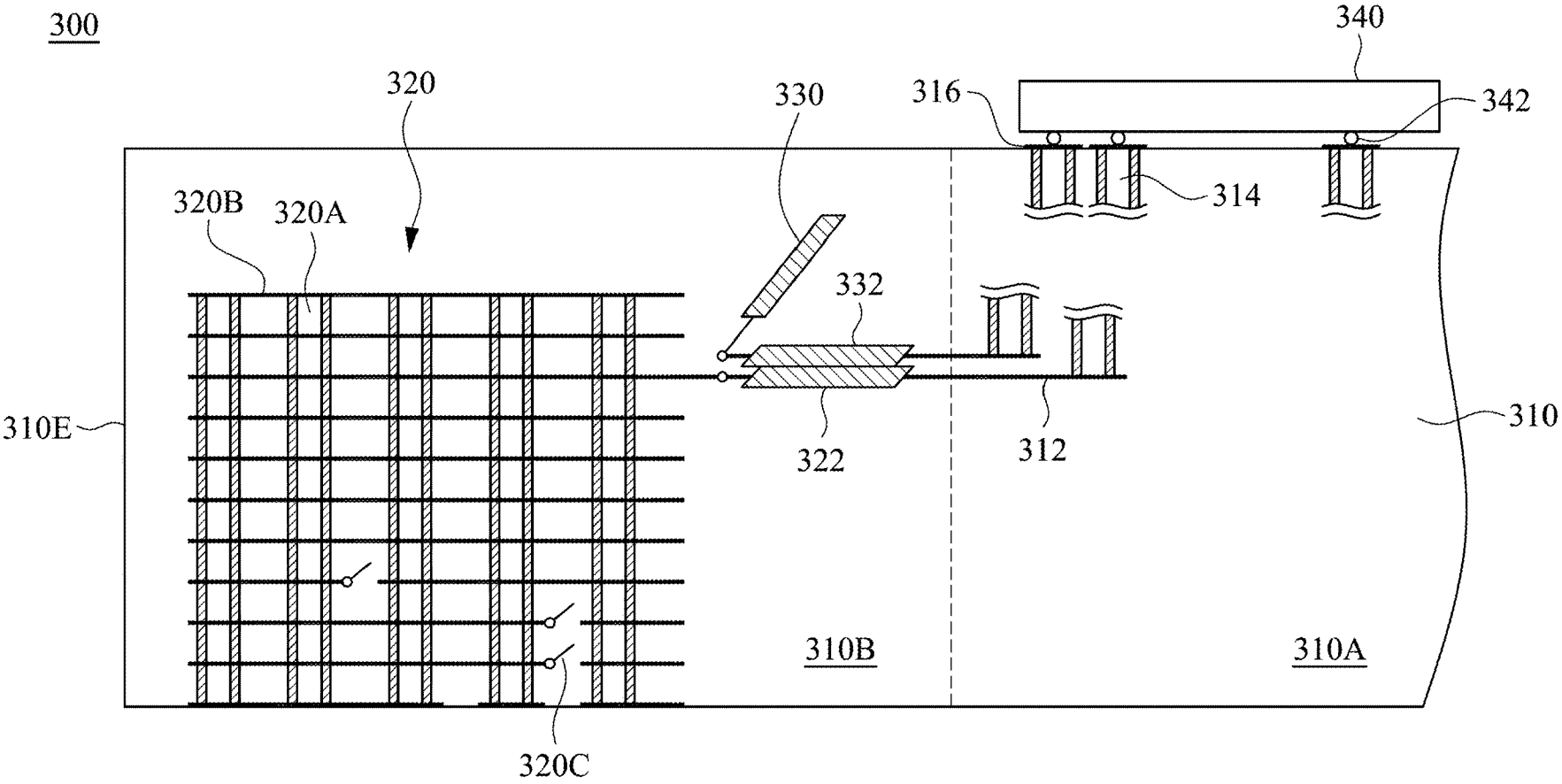
FIG. 3 is a partial structural diagram of an antenna structure in accordance with some embodiments of the invention.

FIG. 3 is a partial structure diagram of an antenna structure 300 in accordance with some embodiments of the invention. As shown in FIG. 3, the conductive lines, the conductive via structures 314 and/or another component are arranged in a center area 310A of a substrate 310, and a vertical radiator 320 and a horizontal radiator 330 are arranged in a peripheral area 3108 of the substrate 310 for collectively forming a monopole antenna or a dual-polarized antenna. The substrate 310 may be a multi-layered board structure similar to the structure formed of alternately stacked dielectric layers 112 and metal layers 114 as illustrated in FIG. 2.

The vertical radiator 320 may be vertically across multiple dielectric layers in the substrate 310. The vertical radiator 320 includes vertical conductors 320A, planar metal structures 320B and switches 320C. The vertical conductors 320A extend along the direction perpendicular to the planar direction of the substrate 310, and the planar metal structures 320B extend along the planar direction of the substrate 310 and are electrically connected through the vertical conductors 320A. In the embodiments, the distance between the adjacent vertical conductors 320A is less than a quarter of the equivalent wavelength of the electromagnetic wave in the substrate 310. As shown in FIG. 3, in some embodiments, the vertical conductors 320A not only have the same length but also have the same height position in the substrate 310. In another embodiment, the vertical conductors 320A may have different lengths and/or different height positions.

In some embodiments, the vertical conductors 320A are formed of through substrate via (TSV) conductors. In practical, the TSV conductors may be conductive by coating conductive liquid/paint or plating conductive metal in the fabricating process.

The conductive via structures 314 and the vertical conductors 320A may be formed of one or more types. As shown in FIG. 3, the conductive via structures 314 include blind via structures and buried via structures, and the conductive via structures 320A are blind via structures. However, embodiments of the invention are not limited thereto. In various embodiments, the conductive via structures 314 and/or the vertical conductors 320A may include blind via structures, buried via structures and/or through via structures, which can be determined according to design requirements.

In addition, the conductive via structures 314 and the vertical conductors 320A may be plated conductive via structures, in which conductive material is plated onto the walls of the via holes, such as copper, gold, aluminum, nickel or another metal, and then a conductive material or an insulating material (e.g. air or epoxy resin) is filled or plugged into the remained spaces, or a conductive material or an insulating material is plugged to form plugged via structures, or a solder mask is disposed on the top and/or the bottom of the spaces to form tented via structures. In another embodiment, the conductive via structures 314 and the vertical conductors 320A may be non-plated conductive via structures, in which conductive material is directly filled into the via holes, such as metal of copper, gold, aluminum, nickel, but are not limited thereto.

The planar metal structures 320B may respectively belong to several metal layers in the substrate 310. The longitudinal direction of the planar metal structures 320B is the horizontal direction of the main beam of the vertical radiator 320. As shown in FIG. 3, in some embodiments, the lengths of the planar metal structures 320B are the same and larger than a quarter of the equivalent wavelength of the electromagnetic wave in the substrate 310. In another embodiment, the lengths of the planar metal structures 320B may be different, and the largest length among the planar metal structures 320B is larger than a quarter of the equivalent wavelength of the electromagnetic wave in the substrate 310. In addition, in some embodiments, as shown in FIG. 3, the planar metal structures 320B are metal strips. In another embodiment, the planar metal structures 320B may have a metal plate with one or more open slots, a combination of the aforementioned metal strip and metal plate, or another suitable metal structure.

The planar metal structures 320B may have one or more planar patterns. For the embodiments of FIG. 3, the first planar metal structure 320B (i.e. the first of the planar metal structure 320B from below) has two gaps, and each of the second to fourth planar metal structures 320B has a gap. The switches 320C are respectively in the gaps of the second to fourth planar metal structures 320B. According to the arrangement of the vertical conductors 320A in the substrate 310, the widths of some or all of the gaps may be smaller than the distance between two adjacent vertical conductors 320A, or alternatively the widths of some or all of the gaps may be larger than the distance between two adjacent vertical conductors 320A. The status of the switch 320C can be controlled to determine whether the metal structures respectively between the two terminals of the switch 320C are electrically connected directly through the switch 320C. When the switch 320C is turned on, the metal structures at the two ends of the switch 320C are electrically connected directly through the switch 320C, i.e. a current flowing through the switch 320C exists. Oppositely, when the switch 320C is turned off, the metal structures at the two ends of the switch 320C are not electrically connected directly through the switch 320C, i.e. the current in the vertical radiator 320 is blocked from flowing through the switch 320C. Because the current distribution determines the radiation pattern generated by the vertical radiator 320, the antenna gain and the radiation pattern of the vertical radiator 320, including main beam direction, half-power beam width (HPBW) and directivity, can be determined by controlling the on and off statuses of each switch 320C. For the embodiments of FIG. 3, the direction of the main beam of the radiation pattern generated by the vertical radiator 320 when each switch 320C is turned on is upper than that when each switch 320C is turned off. Therefore, the radiation pattern of the antenna structure 300 can be switched by turning on or turning off each switch 320C.

In accordance with the type and fabrication process of the substrate 300, each switch 320C may be a diode, a field effect transistor (FET), a metal oxide semiconductor (MOS) FET, or a combination thereof, but is not limited thereto.

The horizontal radiator 330 is a planar metal plate structure, and the length thereof may be approximately a quarter of the equivalent wavelength of the electromagnetic wave in the substrate 310. The horizontal radiator 330 and one of the planar metal structures 320B may be coplanar, i.e. belong to the same metal layer in the substrate 310, determining the vertical direction of the main beam of the vertical radiator 320.

As shown in FIG. 3, the vertical radiator 320 is closer to the side edge 310E of the substrate 310 than the horizontal radiator 330. In another embodiment, the horizontal radiator 330 may be closer to the side edge 310E of the substrate 310 than the vertical radiator 320, or else the distance between the horizontal radiator 330 and the side edge 310E of the substrate 310 is similar to that between the vertical radiator 320 and the side edge 310E of the substrate 310.

The vertical radiator 320 and the horizontal radiator 330 are electrically coupled to the conductive lines 312, the conductive via structures 314 and/or another component in the substrate 310 and in the center area 310 respectively through the feeding traces 322, 332. The feeding trace 322 and one of the planar metal structures 320B may belong to the same metal layer in the substrate 310, and the feeding trace 332 and the horizontal radiator 330 may belong to the same metal layer in the substrate 310. The feeding traces 322, 332 may be parallel microstrip line structures or other transmission line structures.

In addition, a chip 340 is further disposed over the center area 310A of the substrate 310, and the side surface of the chip 340 toward the substrate has metal bumps 342 thereon. By bonding the metal bumps 342 to the bonding pads 316 on the substrate 310, the chip 340 can be mounted on the substrate 310 to have the components in the chip 340 and the conductive lines 312, the conductive via structures 314 and/or other components in the substrate 310 electrically connected with each other, such that the chip 340 is electrically connected with the vertical radiator 320 and the horizontal radiator 330. The metal bumps 342 may be gold bumps, tin bumps or other bumps formed from another metal or metal alloy.

The chip 340 has an RFIC and/or other active and/or passive components for constituting a transmitting and/or receiving circuit. The chip 340 may be bonded to the substrate 310 by such as ball grid array (BGA) packaging, chip scale packaging (CSP), flip chip packaging, wafer-level packaging, or another suitable packaging method, such that the components in the chip 340 and in and and/or on the substrate 310 are electrically connected with each other.

In another embodiment, the antenna structure 300 may only include the substrate 310 and the components in the substrate 310, e.g., the vertical radiator 320 and the horizontal radiator 330, without including the chip 340 and the metal bumps 342.

In addition, in some embodiments, a reflective wall structure (not shown) may be arranged between the area of the vertical radiator 320 and the horizontal radiator 330 and the center area 310A for increasing the directivity of the beam generated by the vertical radiator 320 and the horizontal radiator 330 and blocking radiation waves from interfering the components in the center area 310A. Similar to the structure formed of the vertical conductors 320A of the vertical radiator 320 and the planar metal structures 320B, the reflective wall structure may be formed of electrically conductive via structures, but the extending directions of the reflective wall structure are approximately parallel to the corresponding side edges 310E.

Furthermore, in some embodiments, a broadband antenna set (not shown) may further be disposed in the antenna structure 300 and be formed of phased array antennas arranged on a side of the chip 340 far away from the substrate 310 for generating a multi-beam array with angles with respect to the planar direction of the substrate 310. The broadband antenna set may be electrically connected with the conductive lines 312, the conductive via structures 314 and/or another component in the center area 310A.

Figure 4:
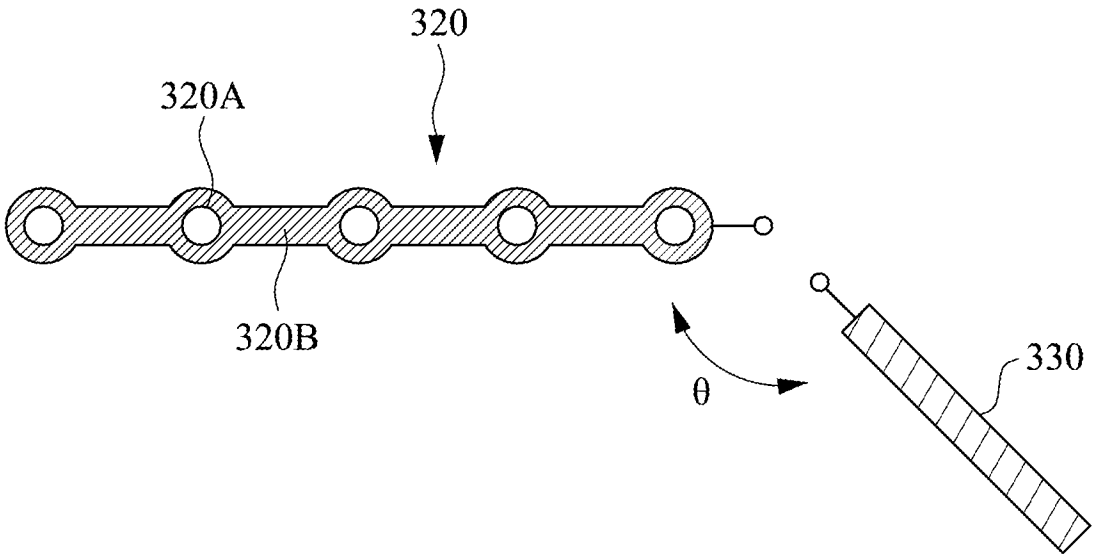
FIG. 4 exemplarily illustrates a partial planar diagram of the antenna structure in FIG. 3.

FIG. 4 exemplarily illustrates a partial planar diagram of the antenna structure 300. In the vertical radiator 320 shown in FIG. 4, the vertical conductors 320A are respectively the vertical conductors 320A shown in FIG. 3, and the planar metal structure 320B is one of the planar metal structures 320B shown in FIG. 3. The angle θ between the longitudinal direction of the planar metal structures 320B and the longitudinal direction of the horizontal radiator 330 is an obtuse angle. As such, the generated radiation pattern may further include a horizontal polarization component perpendicular to the longitudinal direction of the planar metal structure 320B. In other embodiments, according to practical application requirements, the angle θ between the longitudinal direction of the planar metal structures 320B and the longitudinal direction of the horizontal radiator 330 may be modified to be a right angle or an acute angle, or otherwise the longitudinal direction of the planar metal structures 320B may be parallel to the longitudinal direction of the horizontal radiator 330.

Figure 5:
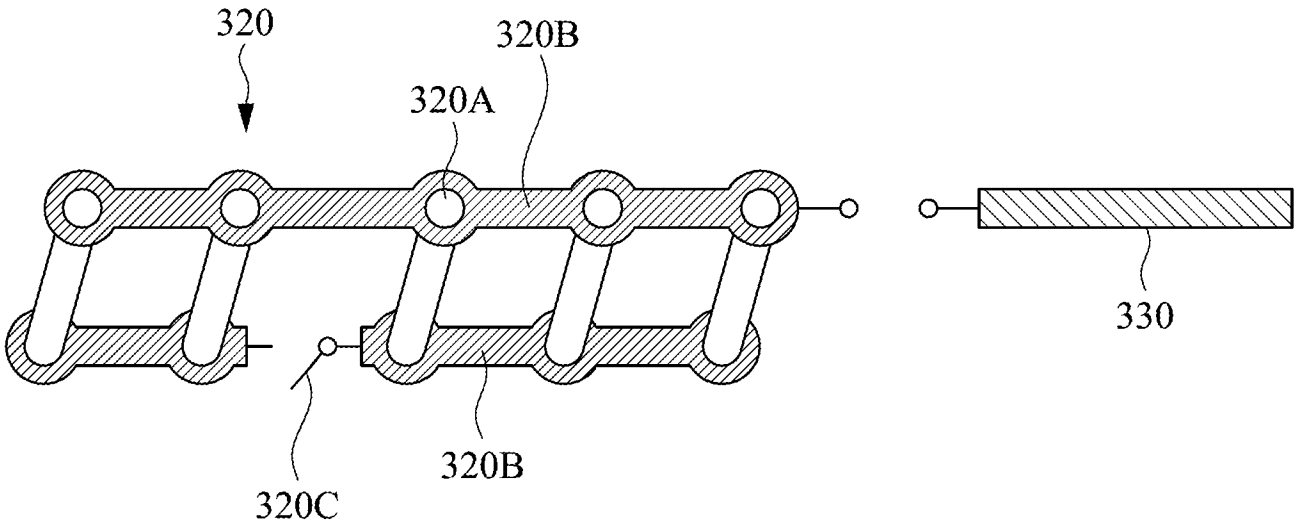
FIG. 5 exemplarily illustrates a partial perspective diagram of the antenna structure in FIG. 3.

FIG. 5 exemplarily illustrates a partial perspective diagram of the antenna structure 300. In the vertical radiator 320 shown in FIG. 5, the vertical conductors 320A are respectively the vertical conductors 320A shown in FIG. 3, and the planar metal structures 320B are adjacent upper and lower ones of the planar metal structures 320B shown in FIG. 3. As shown in FIG. 5, the switch 320C is in the gap of the lower planar metal structure 320B. When the switch 320C is turned on, each of the upper and lower planar metal structures 320B has a complete current path. Oppositely, when the switch 320C is turned off, because the metal structures at the two ends of the switch 320C have to be electrically connected through the vertical conductors 320A and the upper planar metal structure 320B (or another planar metal structure other than the upper and lower ones in FIG. 5) rather than directly through the switch 320C, the upper planar metal structure 320B still has a complete current path, but the lower planar metal structure 320B does not have a complete current path, such that the overall current distribution of the vertical radiator 320 is changed accordingly. The overall current distribution of the vertical radiator 320 may be changed by switching the on and off statuses of the switch 320C, so as to switch the radiation pattern of the vertical radiator 320.

Figure 6:
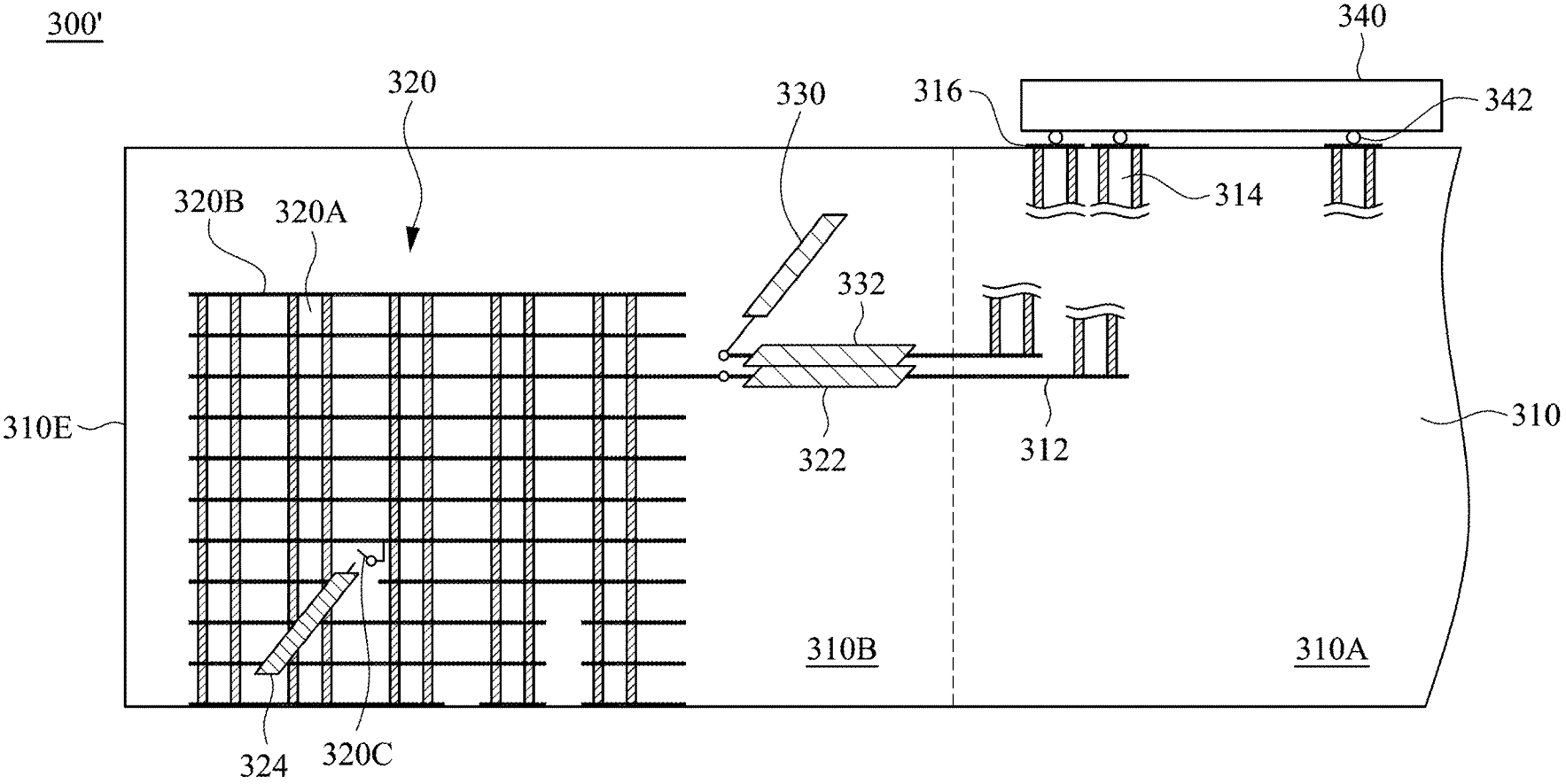
FIG. 6 is a partial structural diagram of an antenna structure in accordance with some other embodiments of the invention.

FIG. 6 is a schematic diagram of an antenna structure 300' in accordance with some other embodiments of the invention. In comparison with the antenna structure 300' of FIG. 3, the antenna structure 300' of FIG. 6 further includes a metal branch 324, and in FIG. 6, the switch 320C is coupled between the metal branch 324 and one of the planar metal structures 320B for controlling whether the metal branch 324 and the planar metal structure 320B are electrically connected or not, and none of the gaps of the planar metal structure 320B has a switch 320C. The other components of the antenna structure 300' are respectively the same as the corresponding components of the antenna structure 300 in FIG. 3, and therefore the related description can be referred to the foregoing paragraphs and is not repeated herein.

Figure 7:
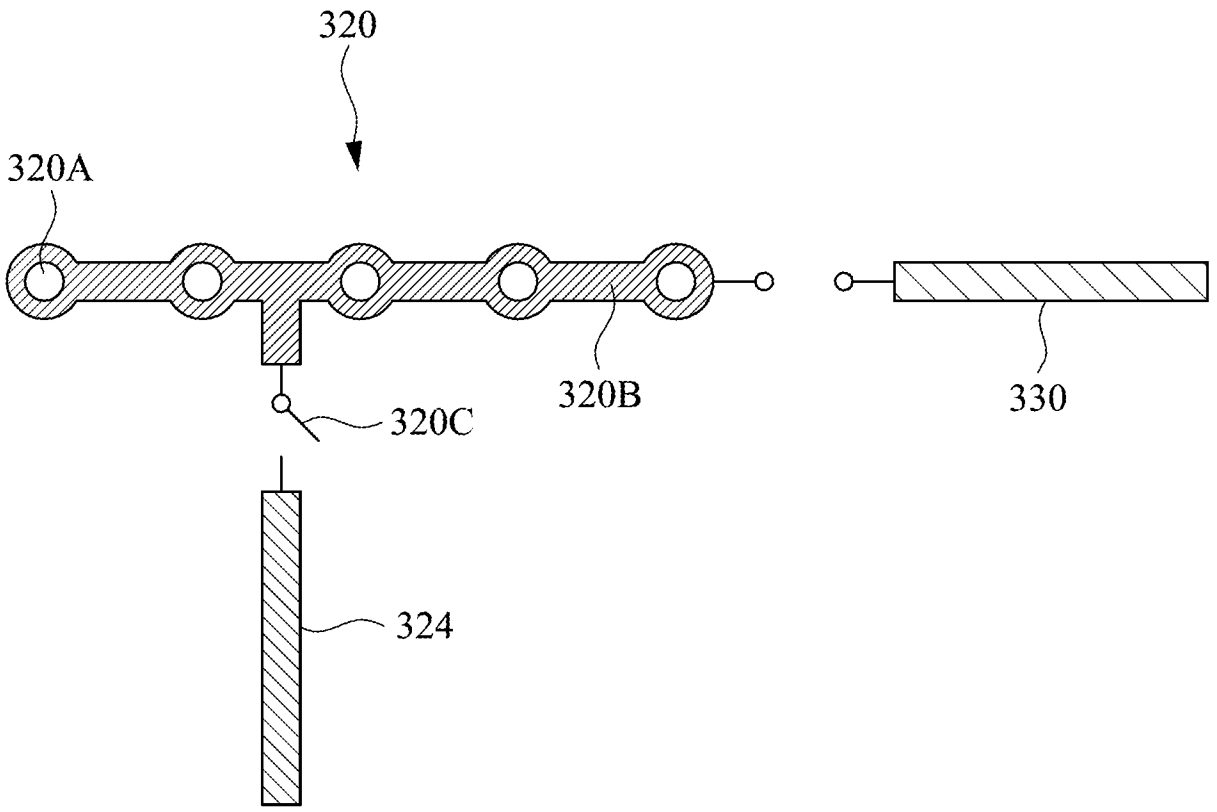
FIG. 7 exemplarily illustrates a partial planar diagram of the antenna structure in FIG. 6.

FIG. 7 is exemplarily illustrates a partial planar diagram of the antenna structure 300'. In the vertical radiator 320 shown in FIG. 7, the vertical conductors 320A are respectively the vertical conductors 320A shown in FIG. 6, the planar metal structure 320B is one of the planar metal structures 320B shown in FIG. 6, the switch 320C is the switch 320C shown in FIG. 7, the vertical conductors 320A are respectively the vertical conductors 320A shown in FIG. 6, and the metal branch 324 is the metal branch 324 shown in FIG. 6.

In FIG. 7, the status of the switch 320C can be controlled to determine whether the planar metal structure 320B and the metal branch 324 respectively between the two terminals of the switch 320C are electrically connected through the switch 320C. When the switch 320C is turned on, the planar metal structure 320B and the metal branch 324 are electrically connected through the switch 320C, and therefore the current in the planar metal structure 320B partially flows through the metal branch 324. Oppositely, when the switch 320C is turned off, the metal structures at the two terminals of the switch 320C are not electrically connected directly through the switch 320C, and therefore the current in the vertical radiator 320 is blocked from flowing through the switch 320C. Because the current distribution determines the radiation pattern generated by the vertical radiator 320, and the longitudinal direction of the metal branch 324 is different from the longitudinal direction of the planar metal structure 320B, the antenna gain and the radiation pattern of the vertical radiator 320, including main beam direction, HPBW, directivity and polarization direction, can be determined by controlling the on and off statuses of the switch 320C. In the embodiments of FIG. 7, the longitudinal direction of the metal branch 324 is perpendicular to the longitudinal direction of the planar metal structure 320B. In other embodiments, according to practical application requirements, the longitudinal direction of the metal branch 324 may not be perpendicular to the longitudinal direction of the planar metal structure 320B. Therefore, the radiation pattern and the polarization status of the antenna structure 300' can be switched by turning on or turning off the switch 320C.

Figure 8:
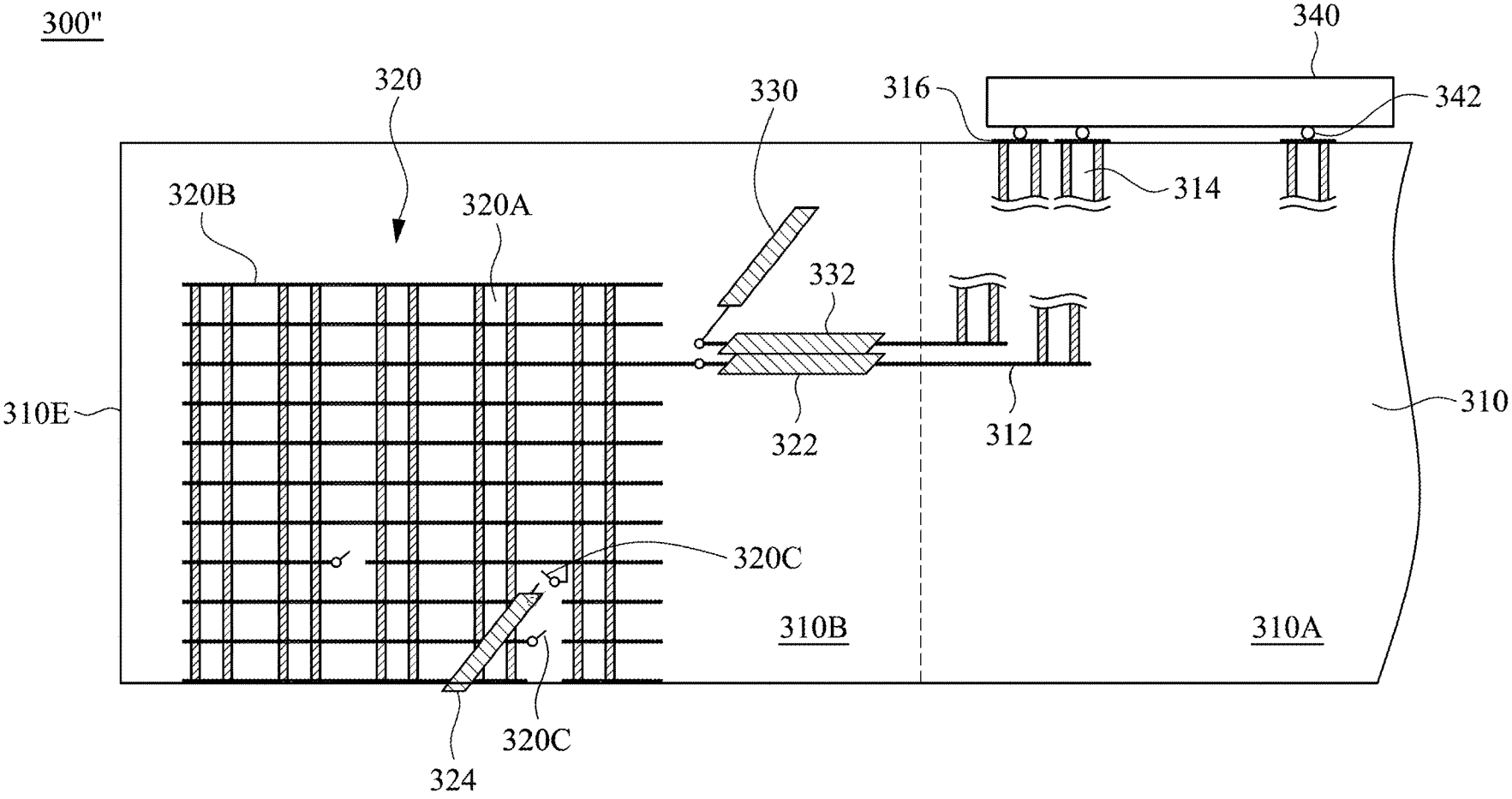
FIG. 8 is a partial structural diagram of an antenna structure in accordance with some other embodiments of the invention.

FIG. 8 is a schematic diagram of an antenna structure 300" in accordance with some other embodiments of the invention. In comparison with the antenna structure 300 in FIG. 3 and the antenna structure 300' in FIG. 6, the antenna structure 300" in FIG. 8 simultaneously includes the metal branch 324, the switch in the gap of the planar metal structure 320B and the switch between the planar metal structure 320B and the metal branch 324. The components in the antenna structure 300" are respectively the same as the corresponding components of the antenna structure 300 in FIG. 3 and/or the antenna structure 300' in FIG. 6, and therefore the related description can be referred to the foregoing paragraphs and is not repeated herein.

Figure 9:
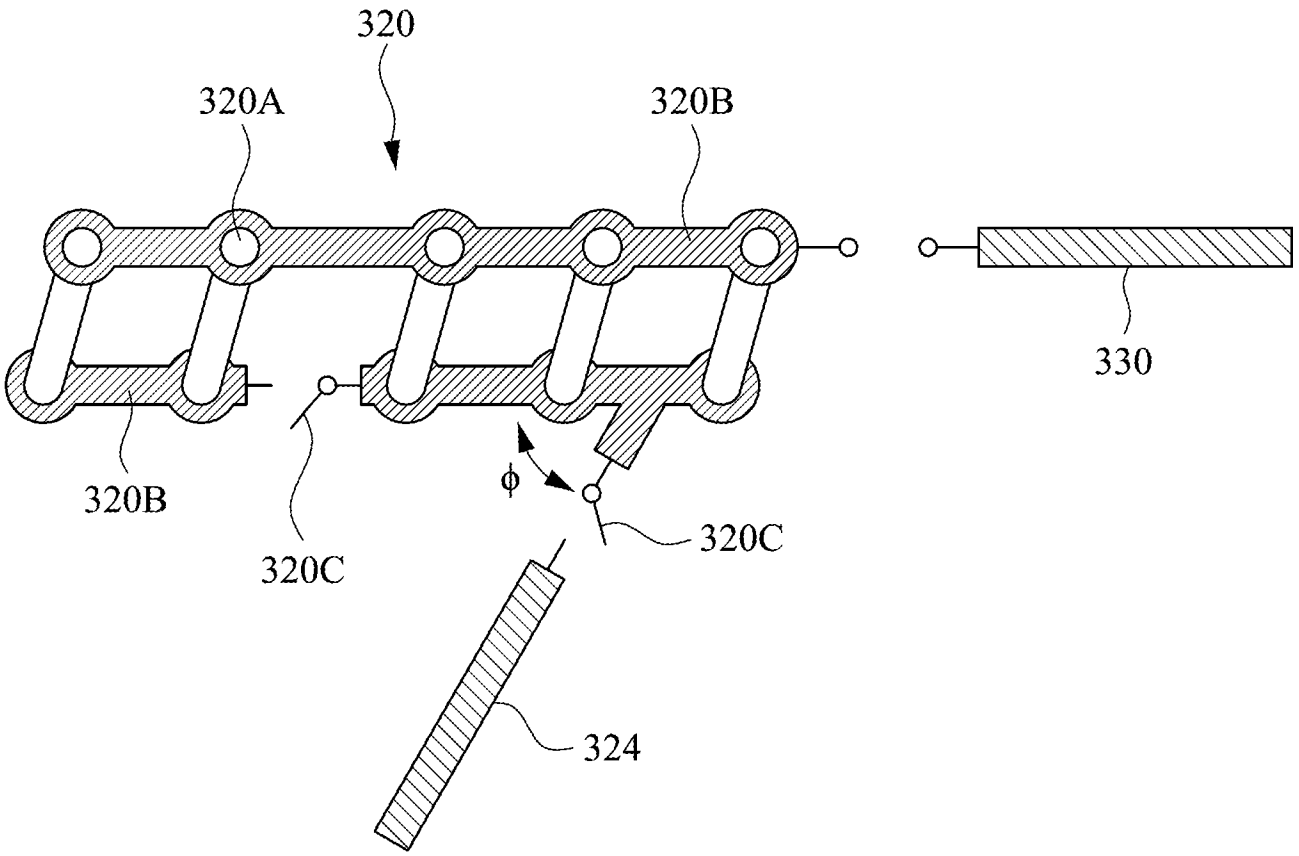
FIG. 9 exemplarily illustrates a partial perspective diagram of the antenna structure in FIG. 8.

FIG. 9 exemplarily illustrates a partial perspective diagram of the antenna structure 300". In the vertical radiator 320 illustrated in FIG. 9, the vertical conductors 320A are respectively the vertical conductors 320A shown in FIG. 8, the planar metal structures 320B are respectively adjacent upper and lower ones of the planar metal structures 320B shown in FIG. 8, the switches 320C are respectively two of the switches 320C shown in FIG. 8, and the metal branch 324 is the metal branch 324. The functions of the switch 320C in a gap of the planar metal structure 320B and the switch 320C between the planar metal structure 320B and the metal branch 324 are respectively the same as the switches 320C in FIG. 5 and FIG. 7. In addition, in the embodiments of FIG. 9, the angle $\phi$ between the longitudinal direction the metal branch 324 and the planar metal structures 320B is an obtuse angle. In another embodiment, according to practical application requirements, the angle $\phi$ between the longitudinal direction of the metal branch 324 and the planar metal structures 320B may be a right angle or an acute angle. Therefore, the radiation pattern and the polarization status of the antenna structure 300" can be switched by turning on or turning off each switch 320C.

It is noted that the arrangements of patterns, locations and quantities of the vertical conductors 320A, the planar metal structures 320B, the switches 320C and the metal branch 324 shown in FIG. 3 to FIG. 9 are merely illustrative examples. For practical designs, the arrangements of patterns, locations and quantities of the vertical conductors 320A, the planar metal structures 320B, the switches 320C and the metal branch 324 may be adjusted according to application requirements, but are not limited to the contents shown in FIG. 3 to FIG. 9.

Summing up the above, the antenna structure of the invention has radiation pattern switching functions of switching its radiation pattern based on its surrounding environment, thus achieving high transmission and reception performances under various environments.

Although the invention is described above by means of the implementation manners, the above description is not intended to limit the invention. A person of ordinary skill in the art can make various variations and modifications without departing from the spirit and scope of the invention, and therefore, the protection scope of the invention is as defined in the appended claims.

What is claimed is:

1. An antenna structure, comprising:
- a substrate; and
- a horizontal radiator on or in the substrate; and
- a vertical radiator in the substrate and comprising:
  - at least one vertical conductor;
  - a plurality of planar metal structures electrically connected through the at least one vertical conductor; and
  - at least one switch in at least one gap of the planar metal structures and coupled to at least one of the planar metal structures for switching a current distribution of the vertical radiator.

2. The antenna structure of claim 1, wherein the at least one switch is a plurality of switches respectively in at least one of the planar metal structures.

3. The antenna structure of claim 1, wherein the planar metal structures comprise at least one of a metal strip and a metal plate that has one or more open slots.

4. The antenna structure of claim 1, wherein the horizontal radiator and one of the planar metal structures are coplanar.

5. The antenna structure of claim 4, wherein the vertical radiator and the horizontal radiator are near a side edge of the substrate.

6. An antenna structure, comprising:
- a substrate; and
- a horizontal radiator on or in the substrate; and
- a vertical radiator in the substrate and comprising:
  - at least one vertical conductor;
  - a plurality of planar metal structures electrically connected through the at least one vertical conductor; and
  - at least one first switch in at least one gap of the planar metal structures and coupled to at least one of the planar metal structures for switching a current distribution of the vertical radiator; and
- a metal branch selectively coupled to the vertical radiator.

7. The antenna structure of claim 6, wherein the at least one first switch is a plurality of first switches respectively in at least one of the planar metal structures.

8. The antenna structure of claim 6, wherein the metal branch and one of the planar metal structures are coplanar.

9. The antenna structure of claim 6, further comprising:

a second switch coupled between the metal branch and one of the planar metal structures for switching the current distribution of the vertical radiator.

10. The antenna structure of claim 6, wherein the planar metal structures comprise at least one of a metal strip and a metal plate that has one or more open slots.

11. The antenna structure of claim 6, wherein the horizontal radiator and one of the planar metal structures are coplanar.

12. The antenna structure of claim 11, wherein the vertical radiator and the horizontal radiator are near a side edge of the substrate.

13. The antenna structure of claim 6, wherein the at least one vertical conductor comprises a conductive via structure.

14. The antenna structure of claim 6, further comprising:

a radio frequency (RF) chip on the substrate and electrically connected to the vertical radiator.

* * * * *